US006907825B2

(12) United States Patent
Böttger et al.

(10) Patent No.: US 6,907,825 B2
(45) Date of Patent: Jun. 21, 2005

(54) DELIVERY FOR A MACHINE FOR PROCESSING FLAT PRINTING MATERIALS

(75) Inventors: Andreas Böttger, Heidelberg (DE); Thomas Schäfer, Heidelberg (DE); Frank Gunschera, Nussloch (DE); Sven Kerpe, Eggenstein-Leopoldshafen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/208,488

(22) Filed: Jul. 29, 2002

(65) Prior Publication Data

US 2003/0019378 A1 Jan. 30, 2003

(30) Foreign Application Priority Data

Jul. 27, 2001 (DE) ..... 101 36 744

(51) Int. Cl.[7] ..... B41F 13/64
(52) U.S. Cl. ..... 101/240; 101/142
(58) Field of Search ..... 101/240, 142, 101/144, 145, 182, 184, 271, 198, 206, 223, 213; 271/182, 183, 204

(56) References Cited

U.S. PATENT DOCUMENTS

| | | | | | |
|---|---|---|---|---|---|
| 3,659,839 | A | * | 5/1972 | Baucke | 271/183 |
| 4,085,930 | A | * | 4/1978 | Weisgerber et al. | 271/204 |
| 4,225,129 | A | * | 9/1980 | Zimmermann et al. | 271/204 |
| 4,469,321 | A | * | 9/1984 | Geschwindner | 271/183 |
| 4,479,645 | A | * | 10/1984 | Pollich | 271/183 |
| 4,830,355 | A | | 5/1989 | Jeschke | |
| 5,088,404 | A | * | 2/1992 | MacConnell et al. | 101/232 |
| 5,259,608 | A | * | 11/1993 | Pollich | 271/183 |
| 5,263,415 | A | * | 11/1993 | Pollich | 101/232 |
| 5,349,904 | A | * | 9/1994 | Ganter | 101/227 |
| 5,411,251 | A | * | 5/1995 | Schmid et al. | 271/195 |
| 5,497,987 | A | * | 3/1996 | Henn et al. | 271/204 |
| 5,568,919 | A | | 10/1996 | Detmers et al. | |
| 5,979,701 | A | | 11/1999 | Wenzel et al. | |
| 6,000,695 | A | * | 12/1999 | Mack et al. | 271/303 |
| 6,056,287 | A | * | 5/2000 | Hirth et al. | 271/204 |

FOREIGN PATENT DOCUMENTS

| | | |
|---|---|---|
| DE | 27 20 674 A1 | 11/1978 |
| DE | 80 03 052 U1 | 5/1980 |
| DE | 34 12 180 A1 | 1/1985 |
| DE | 245 417 A1 | 5/1987 |
| DE | 36 34 400 C2 | 3/1990 |
| DE | 44 24 483 A1 | 1/1996 |
| DE | 196 14 491 A1 | 11/1996 |
| DE | 44 24 483 C2 | 3/1999 |
| DE | 199 47 810 A1 | 4/2001 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A delivery for a machine for processing flat printing materials includes sheet brakes for accepting sheets fed in a processing direction at an acceptance level and for releasing the sheets at a surrender level. The sheet brakes are adjustably disposed for varying the acceptance level and the surrender level. A machine is provided for processing flat printing materials, having the delivery.

10 Claims, 6 Drawing Sheets

DELIVERY FOR A MACHINE FOR PROCESSING FLAT PRINTING MATERIALS

BACKGROUND OF THE INVENTION

Field of the Invention

The invention relates to a delivery for a machine for processing flat printing materials, in particular a sheet-processing rotary printing press, having sheet brakes which accept, at an acceptance level, a sheet fed in a processing direction, and which release the sheet at a surrender or release level, and also to a machine for processing flat printing materials, which is equipped with such a delivery, in particular a sheet-processing rotary printing press.

Sheet brakes in machines for processing flat printing materials, such as sheet-processing rotary printing presses, in particular, serve for slowing down the processed printing materials from a processing speed to a depositing speed, and operate on the principle that braking elements penetrated by vacuum, which are moved at a suitably low speed, attract by suction printing materials released above the braking elements by a transport device, in particular in the form of revolving gripper systems dragging the printing materials in a direction towards the sheet brakes, and after the printing materials have been braked to a depositing speed, in turn, release the printing materials, so that the thus braked printing materials then move freely in a direction towards leading edge stops which are provided for forming a sheet pile and which assume one and the same position for all the formats of the printing materials processed by the machine. In order to keep the free path covered by the printing materials released by the braking elements as short as possible, the sheet brakes are displaced downstream with respect to the processing direction in order to adapt to a respectively smaller format of the processed printing materials, and are set to a respective position matched to the format. Sheet brakes operating and positionable in this way are disclosed, for example, by German Patent DE 44 24 483 C2, corresponding to U.S. Pat. No. 5,568,919.

In order to grip and suck the printing materials reliably against the braking elements, it is advantageous to place the latter as close as possible to the path swept by the gripper systems, because the vacuum that acts through the braking elements develops an adequate suction action only when there are small distances between the braking elements and the printing materials. Such placement of the braking elements, i.e., of the sheet brakes, is disadvantageous, however, in particular when there is a relatively long overlap, on the one hand, of printing materials attracted to the braking elements by suction and already retarded and, on the other hand, of printing materials continuing to be dragged by the gripper systems, such as is the case, in particular, when processing large-format printing materials, and can result in smearing of the printed image and, in particular, to turning over or so-called dog-earing of trailing corners of the printing materials.

Therefore, the reliable braking of the printing materials, on the one hand, and the ensuring of satisfactory printed products, on the other hand, place conflicting requirements on the method step of braking printing materials.

SUMMARY OF THE INVENTION

It is accordingly an object of the invention to satisfy the conflicting requirements explained hereinbefore, i.e., of achieving reliable braking while ensuring satisfactory printing quality. More specifically, it is an object of the invention to provide a delivery for a machine for processing flat printing materials which satisfies the foregoing requirements.

With the foregoing and other objects in view, there is provided, in accordance with an aspect of the invention, a delivery for a machine for processing flat printing materials, comprising sheet brakes for accepting sheets fed in a processing direction at an acceptance level and for releasing the sheets at a surrender or release level, the sheet brakes being adjustably disposed for varying the acceptance level and the surrender or release level.

In accordance with another aspect of the invention, there is provided a delivery for a sheet-processing rotary printing press, comprising sheet brakes for accepting sheets fed in a processing direction at an acceptance level and for releasing the sheets at a surrender or release level, the sheet brakes being adjustably disposed for varying the acceptance level and the surrender or release level.

In accordance with a further feature of the invention, the sheet brakes have a translatorily adjustable arrangement.

In accordance with an added feature of the invention, the delivery further comprises a guide arranged for rising downstream with respect to the processing direction and along which the sheet brakes are adjustable in the processing direction and counter thereto.

In accordance with an additional feature of the invention, the delivery further comprises a guide oriented in the processing direction, the sheet brakes being adjustable in height.

In accordance with yet another feature of the invention, the guide is adjustable in height.

In accordance with yet a further feature of the invention, the sheet brakes are adjustable in height with respect to the guide.

In accordance with yet an added feature of the invention, the sheet brakes are rotationally adjustable for varying the surrender or release level.

In accordance with yet an additional feature of the invention, the sheet brakes comprise suction belts for forming braking strands, the suction belts being endless and being revolvable during operation, the rotational adjustability of the suction belts serving for setting to different levels a respective end of the braking strands disposed downstream with respect to the processing direction.

In accordance with a concomitant aspect of the invention, there is provided a machine for processing flat printing materials, having a delivery, comprising sheet brakes for accepting sheets fed in a processing direction at an acceptance level and for releasing the sheets at a surrender level, the sheet brakes being adjustably disposed for varying the acceptance level and the surrender level.

In order to achieve the foregoing objects, the delivery referred to at the introduction hereto is developed with sheet brakes arranged so as to be adjustable in a manner that the acceptance level and the surrender or release level are variable.

This provides the option of adapting the acceptance level and the release level both to the format of the processed sheets and also to the grammage and the stiffness thereof.

To this end, during the processing of the printing materials having the largest processable format, the acceptance level and the release level are preferably set lower than when processing the printing materials having the smallest processable format.

Positioning the sheet brakes at a lower level when processing the largest-format printing materials complies with the behavior of these printing materials being dragged by a respective gripper system, in that the trailing end section thereof moves on a path which lies considerably below the path of the respectively leading gripper edge of these printing materials clamped in the respective gripper system, so that the result of this has also no disadvantageous effect upon the reliable attraction of these printing materials by suction to the braking elements of the sheet brakes.

Other features which are considered as characteristic for the invention are set forth in the appended claims.

Although the invention is illustrated and described herein as embodied in a delivery for a machine for processing flat printing materials, it is nevertheless not intended to be is limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
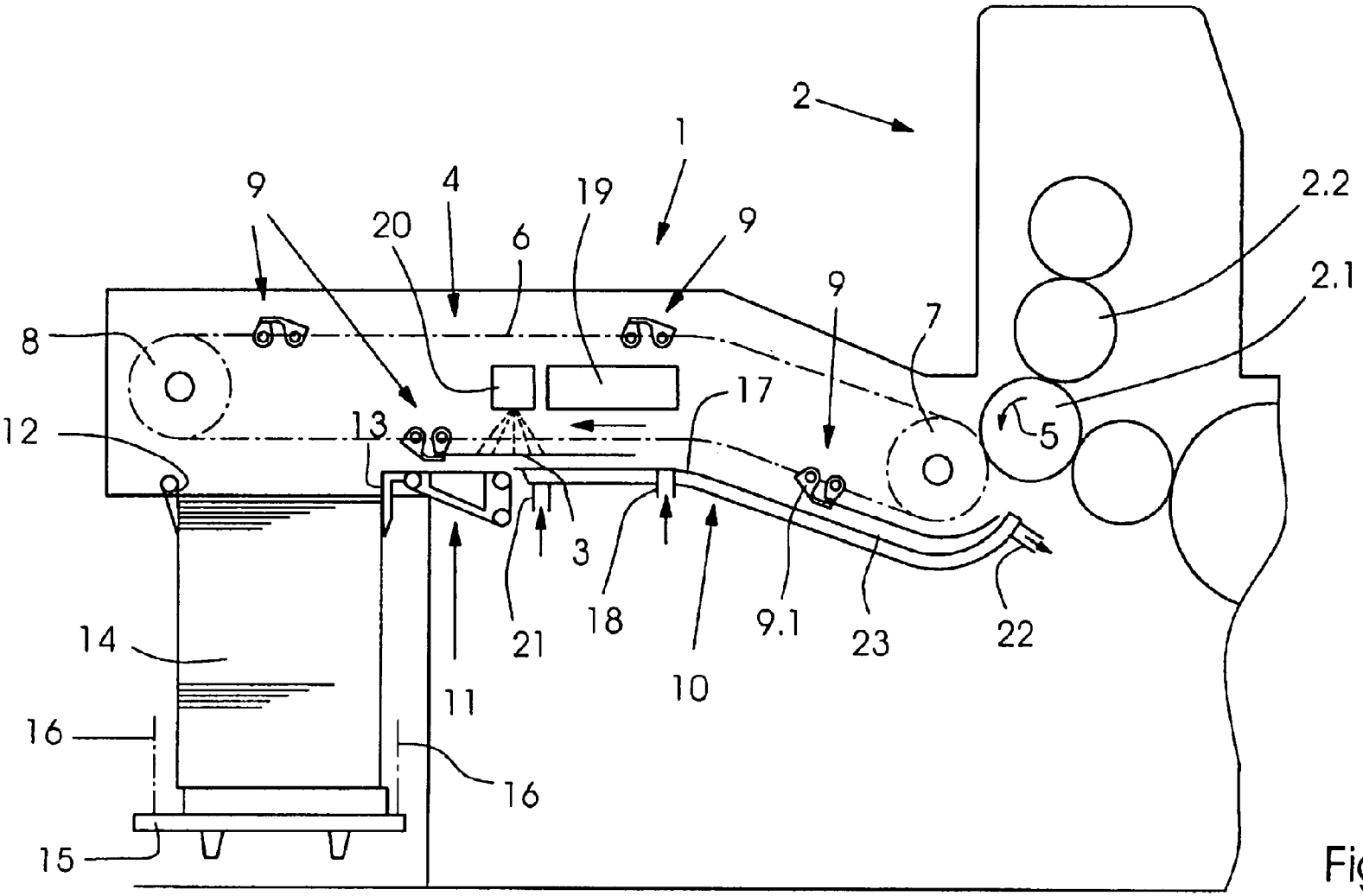
FIG. 1 is a fragmentary diagrammatic side elevational view, i.e., of an end section encompassing a delivery, of a sheet-processing rotary printing press.

Referring now to the drawings and, first, particularly to FIG. 1 thereof, there is shown therein a section of a sheet-processing rotary printing machine comprising a delivery 1 which follows a last processing station. Such a processing station may be a printing unit or a post-treatment unit, such as a varnishing unit. In the example of FIG. 1, the last processing station is a printing unit 2 operating with the offset process and having an impression cylinder 2.1. The latter carries a respective sheet 3 in a processing direction represented by the direction arrow 5 through a printing nip between the impression cylinder 2.1 and a blanket cylinder 2.2 cooperating with the latter, and subsequently transfers the sheet to a chain conveyor 4 while opening grippers arranged on the impression cylinder 2.1 and provided in order to grip the sheet 3 at a gripping edge at the leading end of the respective sheet 3. The chain conveyor 4 comprises two conveyor chains 6, of which a respective chain runs along a respective side wall of the chain delivery 4 during operation. A respective conveyor chain 6 is looped around a respective one of two synchronously driven drive sprockets 7 having axes of rotation which are aligned with one another and, in the example of FIG. 1, is respectively guided over a guide sprocket 8 located opposite the drive sprockets 7 and downstream therefrom with respect to the processing direction. Between the two conveyor chains 6, there extend gripper systems 9 borne by the chains 6 and having grippers 9.1, which pass through gaps between grippers arranged on the impression cylinder 2.1 and, in the process, accept a respective sheet 3 by gripping the aforementioned gripping edge at the leading end of the respective sheet 3 directly before the grippers arranged on the impression cylinder 2.1 open, then transport the sheet 3 over a sheet guide device 10 in a processing direction 10' (note FIG. 2) to a braking station 11 comprising sheet brakes 11.1, and open thereat in order to transfer the sheet 3 to sheet brakes 11.1. The latter impart to the sheets 3 a depositing speed which is reduced with respect to the processing speed and, after reaching the depositing speed, in turn, release the sheets 3, so that a respective, now retarded, sheet 3 finally encounters leading-edge stops 12 and, being aligned on the leading-edge stops 12 and on trailing-edge stops 13 located opposite thereto, together with preceding and/or following sheets 3, forms a sheet pile 14 which is lowerable, by a lifting mechanism, to the extent to which the sheet pile 14 grows. Of the lifting mechanism, only a platform 15 carrying the sheet pile 14, and lifting chains 16 carrying the platform 15 and shown in phantom are reproduced in FIG. 1.

Along the paths between the drive sprockets 7, on the one hand, and the guide or reversing sprockets 8, on the other hand, the conveyor chains 6 are guided by chain guide rails, which therefore determine the chain paths of the chain strands or runs. In the example of FIG. 1, the sheets 3 are transported by the lower chain strand. The portion of the chain path through which the lower chain strand passes is followed alongside by a sheet guide surface 17 which faces the lower chain strand and is formed on the sheet guide device 10. Between the guide surface 17 and the sheet 3 respectively guided thereover, a carrying air cushion is preferably formed during operation. For this purpose, the sheet guide device 10 is equipped with blast or blown-air nozzles which open into the sheet guide surface 17, only one thereof shown as a nozzle 18 being reproduced in FIG. 1 and being representative symbolically of all thereof.

In order to prevent mutual sticking or adhesion of the printed sheets 3 in the sheet pile 14, a dryer 19 and a powdering device 20 are provided on the path of the sheets 3 from the drive sprockets 7 to the braking station 11.

In order to avoid excessive heating of the sheet guide surface 17 by the dryer 19, a coolant circuit, which is represented symbolically in FIG. 1 by an inlet nozzle 21 and an outlet nozzle 22 on a coolant trough 23 associated with the sheet guide surface 17, is integrated into the sheet guide device 10.

The sheet brakes 11.1 are constructed, for example, as suction belt brakes having endless suction belts 11.2 which run over rollers 11.2' during operation. They are lined up in a row transversely with respect to the processing direction at mutual intervals which, in a preferred configuration not specifically illustrated here, can be varied in such a way that the suction belts 11.2 can be set to print-free corridors on the printed underside of the sheets 3 during a verso or perfector printing operation of the rotary printing press.

Depending upon the print job, the sheets 3 can have different formats, which extend from a largest format that can yet be processed to a smallest format that is yet tolerable for economic operation.

FIG. 1 illustrates the case of processing the largest-format sheets, by way of example. In order to process the sheets, respectively, having a smaller format, the position of the sheet brakes 11.1 are matched to the respective smaller format in that they are adjusted downstream with respect to the processing direction 10' (note FIG. 2) along a guide and, with respect to the latter, are in turn positioned in such a way that the distance provided when processing the largest-format sheets between the suction belts 11.2 and the upper edge directed upstream from the sheet pile 14 to be formed is maintained for the most part, even in the case of a sheet pile of a respective smaller format to be aligned on the leading-edge stops 12.

Figure 2:
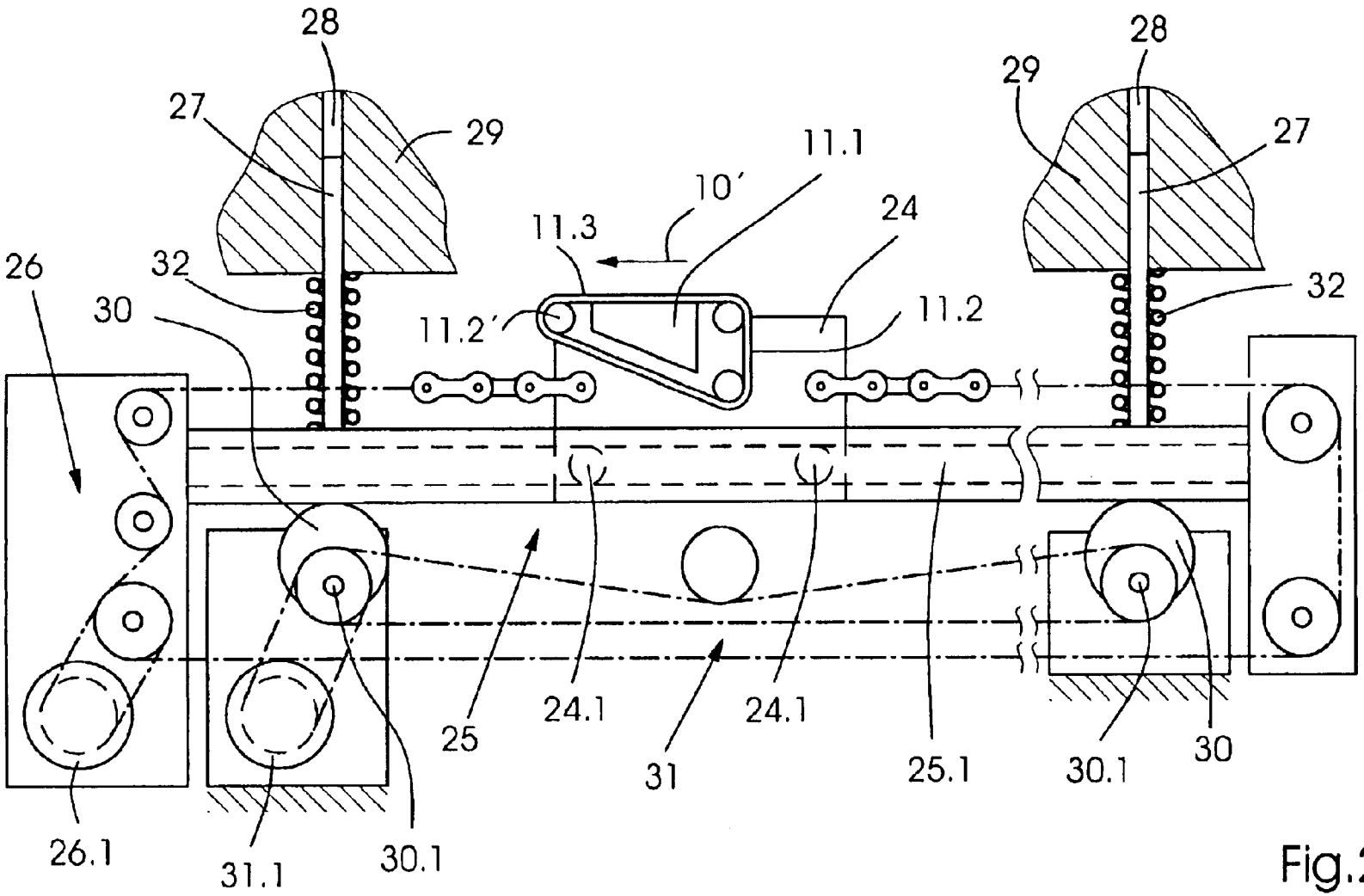
FIG. 2 is an enlarged fragmentary view of FIG. 1 showing a different embodiment of the invention which has a guide for vertically adjustable sheet brakes thereof which are liftable and lowerable.

As can be seen from FIG. 2, to this end, a braking carriage 24 is provided, which carries the sheet brakes 11.1 and has runner rollers 24.1, and is movable along the aforementioned guide and can be positioned at selectable locations along the guide. The braking carriage 24 extends transversely with respect to the processing direction 10', at least approximately over the clear width of the delivery. In the vicinity of a respective side wall of the delivery, bounding the clear width, there is arranged a respective guide rail 25.1, 25.2, U-shaped in this embodiment, the respective limbs of which extend into the interior of the delivery and form guide tracks for the runner rollers 24.1 engaging in the guide rails. Of appropriate guide rails which can be seen in FIG. 4, one thereof is shown in FIG. 2.

In order to adjust the sheet brakes 11.1 along a guide 25 comprising the guide rails 25.1 and 25.2, the braking carriage 24 carrying the sheet brakes 11.1 is inserted into a chain of a chain drive 26. By appropriately driving a motor 26.1 (note FIG. 2) for driving the chain drive, the braking carriage 24 can be moved along the guide 25 to selectable locations. The location at which the sheet brakes 11.1 act can therefore be adapted to the respective job-based format of the sheets 3 which are being processed. In particular, therefore, in the course of a job change during which large-format sheets 3 were previously processed, the sheet brakes 11.1 can be adjusted downstream with respect to the processing direction 10' and positioned with respect to the guide 25 in order to process sheets 3 with a smaller format.

The guide 25 and the chain drive 26 form a structural unit which can be adjusted vertically by suitable actuating members and which, in the illustrated example, further comprises vertical guide shafts 27 which are connected to the guide 25 and which engage slidingly in guide bores 28 machined in guide elements 29 which, for their part, are rigidly connected to a respective side wall of the delivery or can also be formed integrally with a respective side wall.

On a side of the guide 25 facing away from the guide shafts 27, i.e., the underside in the example of FIG. 2, the guide 25 is supported on eccentrics 30, which are expediently arranged in one end section of the guide 25 which is disposed upstream with respect to the processing direction, and on eccentrics 30 which is disposed downstream with respect to the processing direction, specifically in such a way that, each of the guide rails 25.1 and 25.2 forming the guide 25 is supported in a respective one of these aforementioned end sections by one of the eccentrics 30. The eccentrics 30 provided in a respective one of the aforementioned end sections can be rotated, respectively, by a common eccentric shaft 30.1. The eccentric shafts 30.1 are driven synchronously by a transmission drive 31 which is preferably formed as a toothed belt drive and is actuated by a motor 31.1, and the eccentrics 30 preferably have mutually identical geometry and phase angle.

By appropriate control of the motor 31.1, the guide 25 can be set to positions between a first level and a second level, higher with respect to the first level, the maximum vertical difference between the second and the first level being presented in FIG. 2 corresponding to the eccentricity of the eccentrics 30 which are used.

Compression springs 32 braced at one end thereof against the guide elements 29 and at the other end thereof against the guide 25 prestress the guide 25 in the direction of the lower, first level and ensure the maintenance of contact between the guide and the eccentrics 30. The eccentric shafts 30.1 are mounted in fixed locations in a conventional manner not otherwise specifically illustrated and therefore, with appropriate rotation thereof, permit the setting of the sheet brakes 11.1 to positions between a first level and a second level disposed higher with respect to the first level. Instead of the eccentrics 30, other types of control cams can, of course, also be used.

In FIG. 2, the guide 25 is reproduced in the installed position thereof in the delivery 1, extending horizontally and, therefore, oriented in the processing direction 10'.

Figure 3:
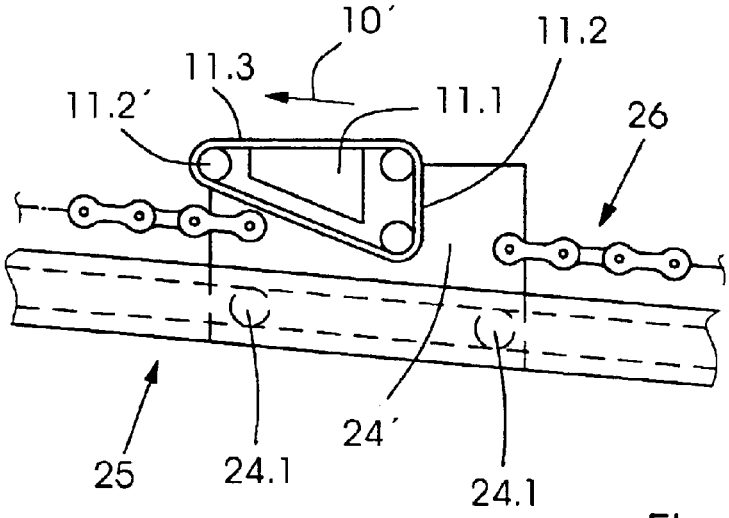
FIG. 3 is a fragmentary view of FIG. 2 showing a modified embodiment of the vertically adjustable sheet brakes having a guide therefor which rises downstream with respect to the processing direction.

FIG. 3 shows the chain drive 26 similar to that of FIG. 2 being used not only to position the sheet brakes 11.1 to match the format of the respectively processed sheets 3 but also as constituting actuating members for adjusting the height of the sheet brakes 11.1. To this end, a guide 25 constructed in accordance with the configuration thereof in FIG. 2 is arranged to rise downstream with respect to the processing direction 10', and a modified brake carriage 24', carrying the sheet brakes 11.1 and provided with runner rollers 24.1 engaging in the guide 25, is provided so as to cause the suction belts 11.2 of the sheet brakes 11.1 to form braking strands 11.3 parallel to the processing direction, just as in the case according to FIG. 2.

In the configuration according to FIG. 3, adjusting members going beyond the chain drive 26 to match the format, for the vertical or height adjustment of the sheet brakes 11.1, can be dispensed with, but the vertical position thereof depends upon the assumed location of the braking carriage 24', respectively, along the guide 25. This dependence is in accord, however, with the intended use of the sheet brakes 11.1, wherein the distance thereof from the path swept by the gripper systems 9 which drag the sheets 3 is smaller the smaller the format of the processed sheets.

Figure 4:
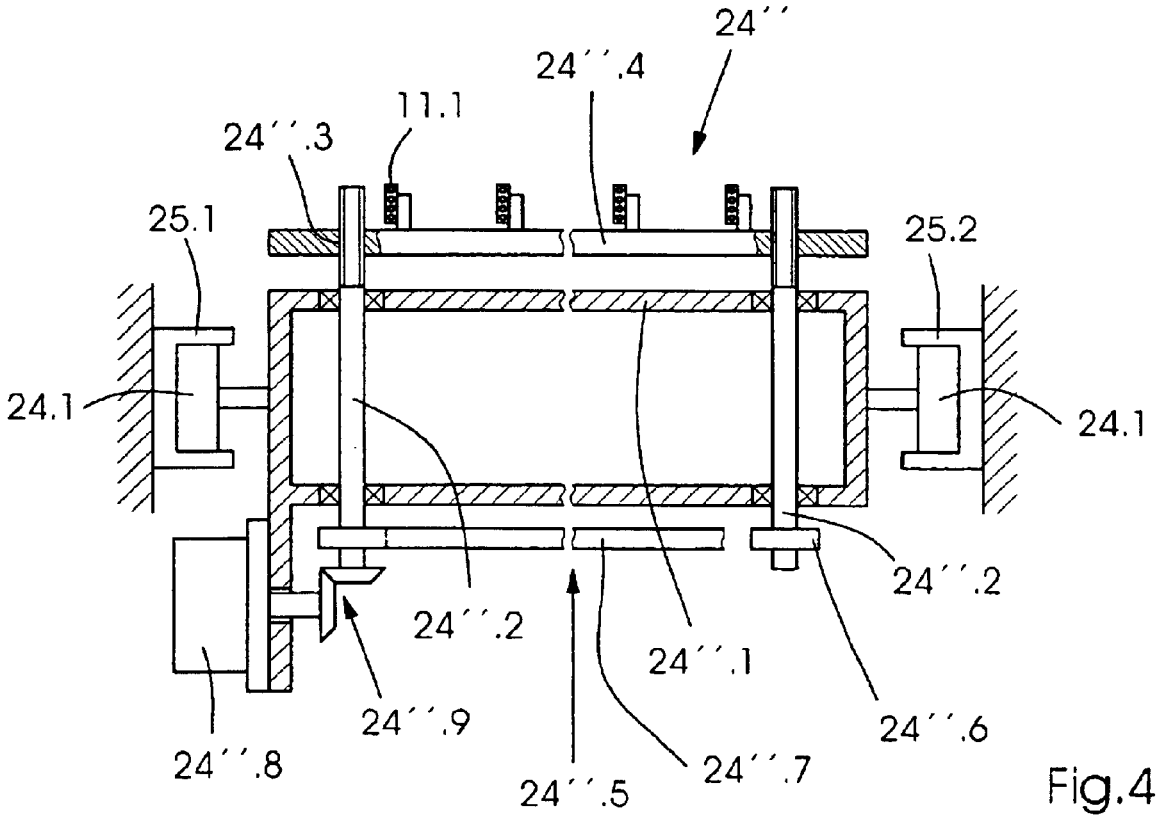
FIG. 4 is an enlarged diagrammatic cross-sectional view taken through the sheet brakes of FIG. 3 and showing a modified construction of the sheet brakes.

In FIG. 4, guide rails 25.1 and 25.2 again oriented in the processing direction and forming the guide 25 are provided, wherein the runner rollers 24.1 of a braking carriage 24" modified to a greater extent than in the aforedescribed embodiments, engage and, in order to adapt the sheet brakes 11.1 from one format of the sheets 3 to be processed to another, again run on appropriate running surfaces on the limbs of the U-shaped guide rails 25.1 and 25.2. The adjustment performed, in this case of the sheet brakes 11.1 carried by the braking carriage 24", and the positioning thereof at appropriate locations along the guide 25, is again performed, for example, with a chain drive which is analogous to the configuration according to FIG. 2 but otherwise not specifically illustrated here.

The braking carriage 24" comprises a moving frame 24".1 bearing the runner rollers 24.1 and having an outline which forms a rectangle, at least approximately. In the moving frame 24".1, for example, in the region of a respective corner of the rectangle, vertical threaded spindles 24".2 are mounted and secured against axial displacement. The threaded spindles 24".2 engage in threaded boreholes 24".3 formed in a holder 2".4 that carries the sheet brakes 11.1 and can therefore be raised and lowered by respective synchronous rotation of the threaded spindles 24".2, so that the sheet brakes 11.1 can be adjusted vertically with respect to the guide rails 25.1 and 25.2 forming the guide and can be set to positions between a first level and a second level, which is higher with respect to the first level.

In order to drive the threaded spindles 24".2, a toothed belt drive 24".5 is provided in the exemplary embodiment of FIG. 4. To this end, the threaded spindles 24".2 are provided with a respective toothed belt pulley 24".6 fixed to the spindles 24".2 so as to rotate therewith. The toothed belt pulleys 24".6 have a toothed belt 24".7 looped around them, and one of the threaded spindles 24".2 is drivable by a reversible motor 24".8 via a bevel gear mechanism 24".9, the motor 24".8 bearing a driving bevel gear flange-mounted to the moving frame 24".1.

In the various configurations described hereinbefore, the suction belts 11.2 which revolve during operation are guided and arranged with regard to the respective braking carriage 24, 24', 24" in such a way that they form braking runs or strands 11.3 which extend horizontally, accept a respective sheet 3 by attracting the latter by suction and release the respective sheet 3 after it has been braked.

In the event of an arrangement of the sheet brakes 11.1 on the respective braking carriage 24, 24', 24" provided in such a way that the orientation of the braking runs or strands 11.3 is basically horizontal, the sheets 3 are accepted and released at one and the same level, but this can be varied to adapt to parameters of the sheets, such as, in particular, the format, grammage or stiffness. A change in the acceptance level and in the surrender level coinciding therewith is, in this case, performed translatorily.

Figure 5:
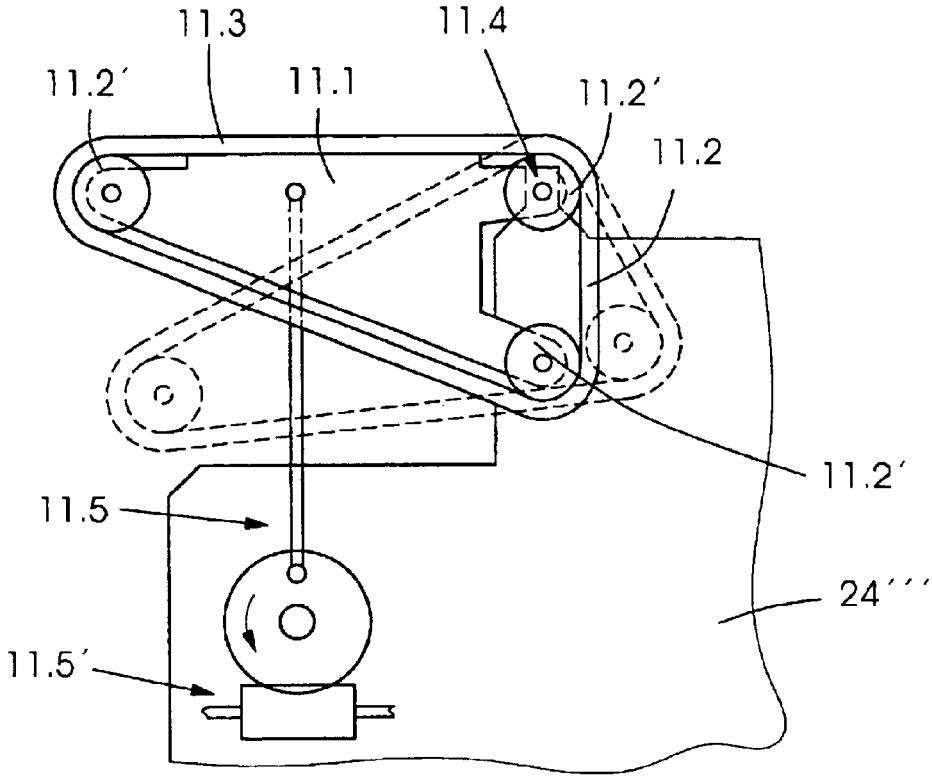
FIG. 5 is an enlarged fragmentary view of FIG. 3 showing a sheet brake in a modified embodiment wherein it is rotationally adjustable.

FIG. 5 shows a braking carriage 24'" which, in particular, is configured analogously to one of the configurations according to FIGS. 2 to 4 and is movably arranged and carries sheet brakes 11.1 comprising suction belts 11.2. A respective suction belt 11.2 again forms a braking strand 11.3. A respective sheet brake 11.1 is mounted on the braking carriage 24'", by a hinged joint 11.4, so that an end of the braking strand 11.3, which is downstream with respect to the processing direction, can be set to lower levels than that assumed by the upstream end of the braking strand 11.3. Such a rotationally adjusted sheet brake 11.1 is illustrated by broken lines in FIG. 5. For the purpose of such a level adjustment, the sheet brake 11.1 in the configuration of FIG. 5 is attached to a crank drive 11.5 which is arranged on the braking carriage 24'" and with which different discharge levels can be set, depending upon the rotational position of the crank.

Figure 5A:
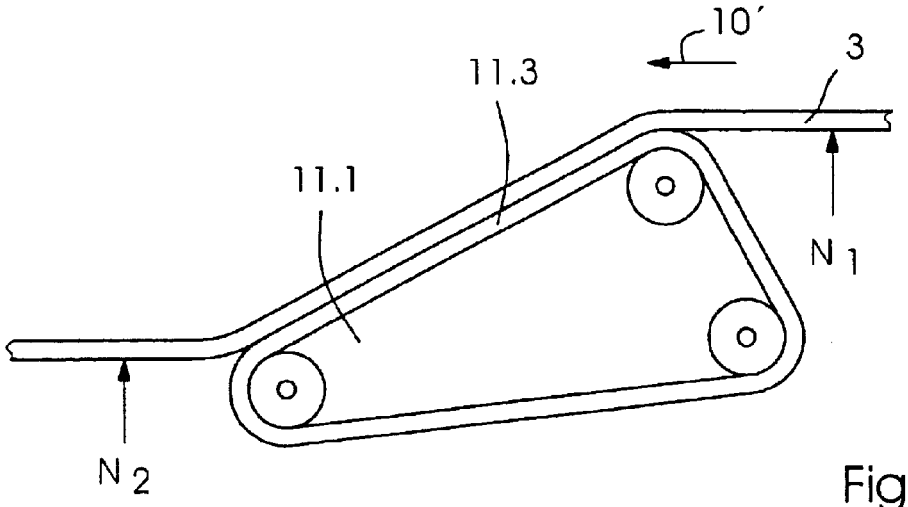
FIG. 5*a* is a view of the sheet brake of FIG. 5 in another operating phase thereof, showing the respective course of a sheet held by the sheet brake when a surrender or release level is lowered with respect to an acceptance level.

In FIG. 5*a*, for the sheet brake 11.1 which can be adjusted rotationally according to FIG. 5 with respect to the braking carriage 24'", the acceptance level N1 and the surrender or release level N2 are indicated in a position of the sheet brake 11.1 wherein the downstream end of the braking strand 11.3 thereof has been lowered with respect to the upstream end of the braking strand 11.3.

Figure 6:
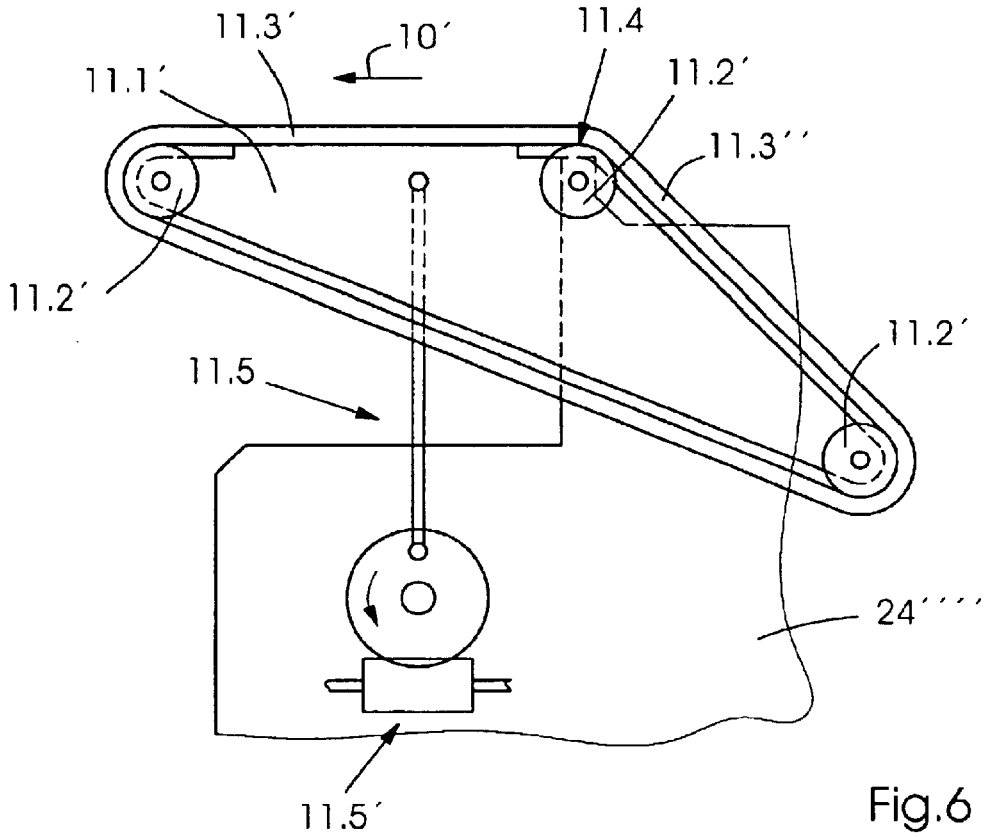
FIG. 6 is an enlarged fragmentary view of FIG. 3 like that of FIG. 5, showing a modified embodiment of the rotationally adjustable sheet brake.

In FIG. 6, in an illustrative embodiment corresponding to that of FIG. 5, an alternative configuration of a sheet brake 11.1' is reproduced. This is again connected via a hinged joint 11.4 to a braking carriage 24"" which, in particular, is configured and arranged to be movable in a manner analogous to that of one of the configurations according to FIGS. 2 to 4 and is constructed so that, respectively, a braking-strand section 11.3', 11.3" extends downstream and upstream, respectively, from the region of the hinged joint 11.4. These sections are inclined with respect to one another so that when one thereof is oriented horizontally, the other thereof is inclined downwardly, starting from the hinged joint 11.4. The different orientations can be set by rotational adjustment of the sheet brake 11.1' with respect to a hinge axis of the hinged joint 11.4. To this end, in an exemplary configuration according to FIG. 6, the sheet brake 11.1' is attached to a crank drive 11.5 arranged on the braking carriage 24"". Depending upon the rotational position of the crank thereof, it is therefore also possible to set the braking-strand section 11.3' in orientations wherein the braking-strand section 11.3" is not pivoted as far as the horizontal.

In order to adjust the rotational position of the crank in the configurations according to FIGS. 5 and 6, a worm drive, for example, is provided. Such an actuating drive is suitable, in particular, for adjusting the sheet brakes 11.1 and 11.1' into a position maintained during production printing, with a level difference defined by this position between the acceptance level N1 and the surrender or release level N2.

Figure 6A:
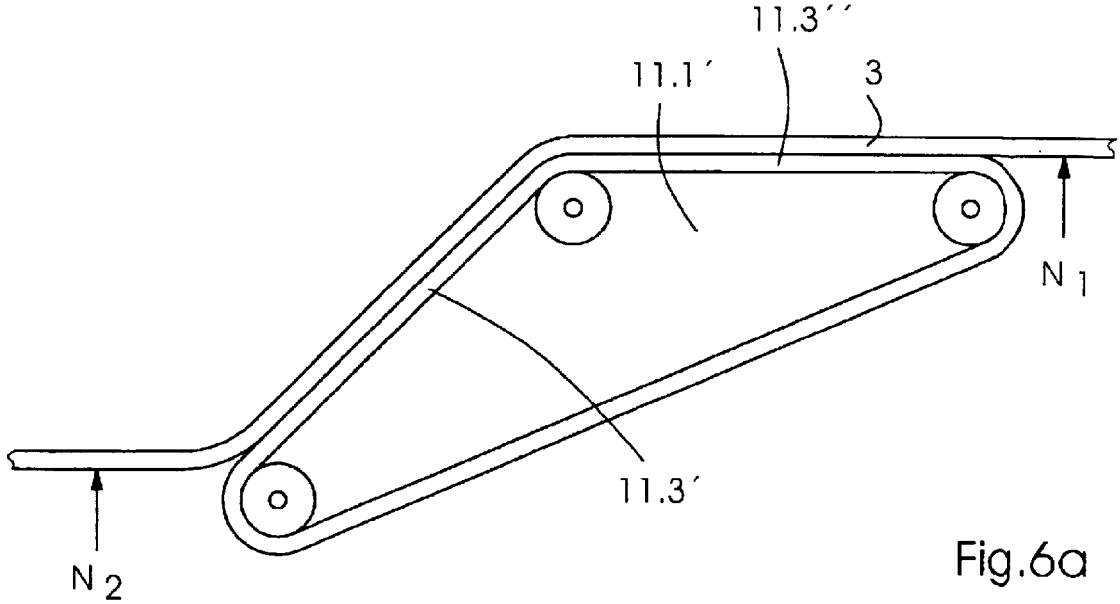
FIG. 6*a* is a view of the sheet brake of FIG. 6 in another operating phase thereof showing the respective course of a sheet held by the sheet brake when a surrender or release level is lowered with respect to an acceptance level.

In FIG. 6*a*, for the sheet brake 11.1' that is adjustable rotationally according to FIG. 6 with respect to the braking carriage 24"", the acceptance level N1 and the surrender or release level N2 are indicated in a position of the sheet brake 11.1' wherein the downstream end of the braking-strand section 11.3' has been lowered.

In a preferred refinement of the invention, the sheet brakes 11.1 and 11.1', respectively, following one another transversely to the processing direction can be set individually to different level differences. A wavy course transverse to the processing direction can therefore be forced on the sheet and, thus, stiffening of the sheets in the processing direction can be achieved.

In an advantageous development, the rotational adjustment of the sheet brakes is performed by a control device 11.6 at the cyclic rate of the sheet sequence, so that a braking strand gripping the sheets in order to transfer the respective sheet is at least approximately equidistant from the path through which the gripper systems which drag the sheets have passed and, after a respective sheet has been transferred, the downstream end of the braking strand is lowered.

Figure 7:
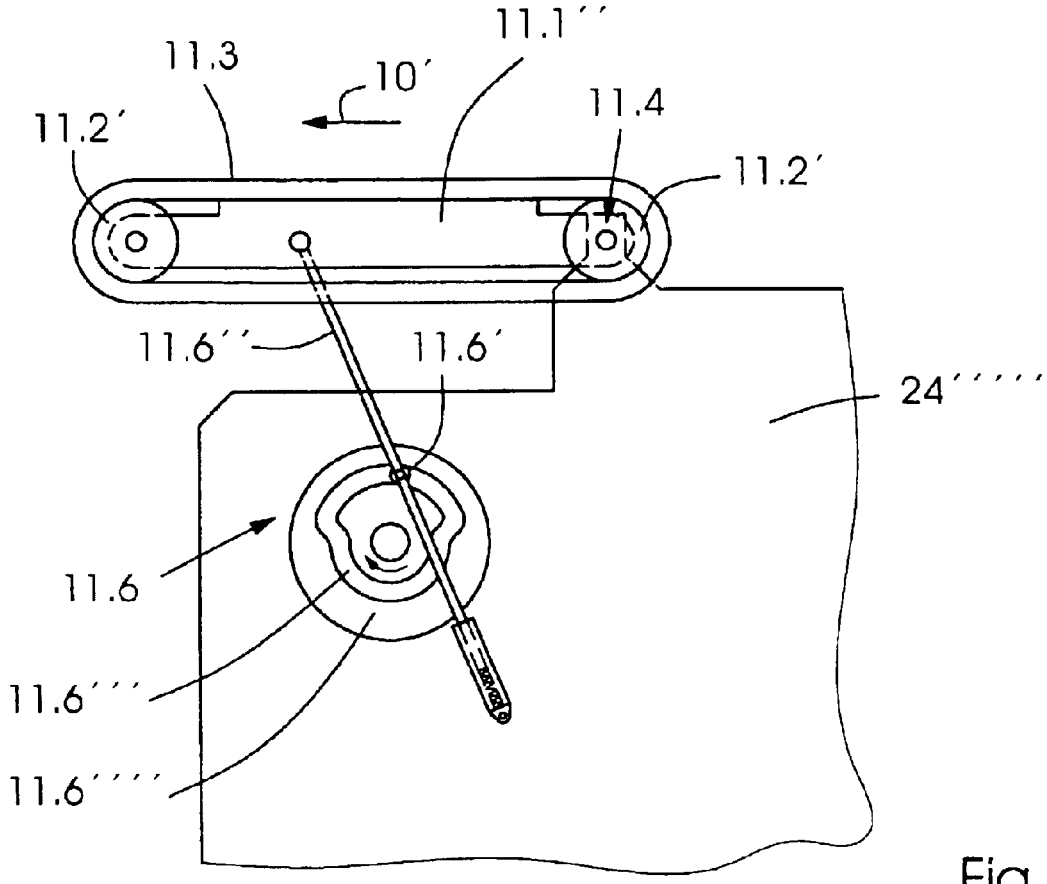
FIG. 7 is a view similar to those of FIGS. 5 and 6 of another modified embodiment of the sheet brake which is adjustable cyclically with the sheet sequence.

FIG. 7 shows an exemplary embodiment of a sheet brake 11.1" that is adjustable at the cyclic rate of the sheet sequence by the aforementioned control device 11.6. In this case, the sheet brake 11.1" in the region of the end of the braking strand 11.3, which is upstream with respect to the processing direction, is connected via a hinged joint 11.4 with a braking carriage 24"" which is, in particular, configured analogously to one of the configurations according to FIGS. 2 to 4 and is movably arranged. Attached to the sheet brake 11.1" is a link 11.6" carrying a cam follower 11.6' in the form of a roller. The cam follower 11.6' engages in an intrinsically closed cam groove 11.6'" in a control cam disk 11.6"" which revolves during operation and forms a first and a second detent.

In the instantaneous setting or position of the control cam disk 11.6"" illustrated in FIG. 7, the cam follower 11.6' is located on a detent which keeps the sheet brake 11.1" at the acceptance level N1 thereof. On the other detent, the downstream end of the braking strand 11.3 is lowered to the surrender or release level N2 in order to release braked sheets.

One advantageous use of the subject of the invention provides for the highest possible acceptance level N1, with which the surrender or release level preferably coincides, for stiff sheets of small format, in particular, and for the lowest possible acceptance level N1 to be provided for large-format and in particular floppy sheets and, preferably, for a surrender or release level N2 lower than the acceptance level N1 to be set, moreover recourse preferably being had to sheet brakes forming braking strands by suction belts, which attract the sheets by suction onto the braking strands until the sheets are close to the downstream end thereof.

We claim:

1. A delivery for a machine for processing flat printing materials, comprising sheet brakes for accepting sheets fed in a processing direction at an acceptance level being a first physical height and for releasing the sheets at a surrender level being a second physical height different from the first physical height, said sheet brakes having a translationally adjustable arrangement, being adjustable in height and being adjustably disposed for varying at least one of said acceptance level and said surrender level, and a guide oriented in said processing direction.

2. The delivery according to claim 1, wherein said sheet brakes are adjustably disposed for varying said surrender level.

3. The delivery according to claim 1, wherein said sheet brakes are adjustably disposed to vary said acceptance level and said surrender level.

4. The delivery according to claim 1, further comprising a guide arranged for rising downstream with respect to said processing direction and along which said sheet brakes are adjustable in said processing direction and counter thereto.

5. The delivery according to claim 1, wherein the machine is a rotary printing press.

6. The delivery according to claim 1, wherein said guide is adjustable in height.

7. The delivery according to claim 1, wherein said sheet brakes are adjustable in height with respect to said guide.

8. The delivery according to claim 1, wherein said sheet brakes are rotationally adjustable for varying said surrender level.

9. The delivery according to claim 8, wherein said sheet brakes comprise suction belts for forming braking strands, said suction belts being endless and being revolvable during operation, said suction belts being rotationally adjustable for setting a respective end of said braking strands disposed downstream with respect to said processing direction to different levels.

10. A machine for processing flat printing materials, having a delivery, comprising sheet brakes for accepting sheets fed in a processing direction at an acceptance level being a first physical height and for releasing the sheets at a surrender level being a second physical height different from the first physical height, said sheet brakes having a translationally adjustable arrangement, being adjustable in height and being adjustably disposed for varying at least one of said acceptance level and said surrender level, and a guide oriented in said processing direction.

* * * * *